US009664100B2

(12) United States Patent
Shomura et al.

(10) Patent No.: US 9,664,100 B2
(45) Date of Patent: May 30, 2017

(54) OUTBOARD MOTOR

(71) Applicant: SUZUKI MOTOR CORPORATION, Hamamatsu-shi, Shizuoka (JP)

(72) Inventors: Nobuyuki Shomura, Hamamatsu (JP); Ryuji Hamada, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 15/041,266

(22) Filed: Feb. 11, 2016

(65) Prior Publication Data

US 2016/0312683 A1 Oct. 27, 2016

(30) Foreign Application Priority Data

Apr. 24, 2015 (JP) ..... 2015-089614

(51) Int. Cl.

| | |
|---|---|
| ***B63H 20/00*** | (2006.01) |
| ***B63H 20/24*** | (2006.01) |
| ***F01N 13/12*** | (2010.01) |
| ***F01N 13/00*** | (2010.01) |
| ***F01N 13/08*** | (2010.01) |
| ***F01N 13/10*** | (2010.01) |

(52) U.S. Cl.

CPC ..... *F01N 13/12* (2013.01); *B63H 20/24* (2013.01); *B63H 20/245* (2013.01); *F01N 13/00* (2013.01); *F01N 13/085* (2013.01); *F01N 13/10* (2013.01); *F01N 2590/021* (2013.01)

(58) Field of Classification Search

CPC ..... F01N 13/12; F01N 13/10; F01N 13/00; F01N 13/085; F01N 2590/021; F01N 2230/04; B63H 20/24; B63H 20/26; B63H 20/245

See application file for complete search history.

(56) References Cited

U.S. PATENT DOCUMENTS

| | | | | |
|---|---|---|---|---|
| 7,867,048 | B2 | 1/2011 | Ochiai | |
| 7,954,314 | B1 * | 6/2011 | Bruestle | F01N 3/2839 60/302 |
| 2009/0215341 | A1 | 8/2009 | Ochiai | |
| 2013/0065462 | A1 * | 3/2013 | Saruwatari | B63H 21/32 440/88 D |
| 2013/0203308 | A1 * | 8/2013 | Kato | B63H 20/24 440/89 C |

FOREIGN PATENT DOCUMENTS

| | | | |
|---|---|---|---|
| JP | 2009197743 | A | 9/2009 |

* cited by examiner

*Primary Examiner* — Anthony Wiest
(74) *Attorney, Agent, or Firm* — Troutman Sanders LLP

(57) ABSTRACT

Disclosed is an outboard motor including an exhaust manifold having a plurality of first openings connected to exhaust ports to form a first passage vertically extending, and an exhaust passage having a second passage extending upward along the exhaust manifold, a third passage that is connected to an upper end portion of the second passage and passes over the exhaust manifold, a fourth passage that is connected to the third passage, turns over to the downside, and then extends downward along the exhaust manifold, so that a lower end portion thereof communicates with a fifth passage provided in the engine holder, the second, third, and fourth passages being arranged in one side of the left-right direction of the cylinder block, wherein the exhaust passage is arranged in a swirling shape, and an exhaust gas cleaning catalyst is installed in a middle portion of the second passage.

4 Claims, 7 Drawing Sheets

OUTBOARD MOTOR

CROSS-REFERENCE TO RELATED APPLICATIONS

This application is based upon and claims the benefit of priority of the prior Japanese Patent Application No. 2015-089614, filed on Apr. 24, 2015, the entire contents of which are incorporated herein by reference.

BACKGROUND OF THE INVENTION

Field of the Invention

The present invention relates to an outboard motor, and more particularly, to an outboard motor preferably employed in a ship model having an engine provided with a catalytic converter.

Description of the Related Art

An outboard motor mounted on a small boat and the like is configured such that an upper unit and a guide exhaust are connected to an upper portion of a lower unit provided with a propeller, an engine is supported and fixed on the guide exhaust, the engine is covered by an engine cover, and the propeller is rotated and driven by the engine. An exhaust gas from the engine is discharged to the seawater through an exhaust passage vertically provided on the side surface of the engine across upper and lower units. In such an engine of the outboard motor, a catalytic converter may be provided in the exhaust passage in order to purify the exhaust gas and comply with an exhaust gas control requirement.

For example, in Patent Document 1, there is discussed a outboard motor structure in which an exhaust gas cleaning catalyst is arranged in one of the side portions of the cylinder block, and the exhaust passage in the downstream side from the exhaust gas cleaning catalyst passes over the cylinder block of the engine and is guided to the opposite side portion in order to prevent flooding to the exhaust gas cleaning catalyst.

Patent Document 1: Japanese Laid-open Patent Publication No. 2009-197743

Meanwhile, in general, an external air inlet duct of the outboard motor is provided in an upper portion of a cowling. Waves or water splash generated by a ship hull may intrude into the external air inlet duct disadvantageously. A water separator capable of preventing intrusion of waves or water splash into the inside of the cowling is disposed in the upper portion of the cowling which is provided with the external air inlet duct. In addition, as discussed in Japanese Laid-open Patent Publication No. 2009-197743, a flywheel magneto 144, a timing belt 55 for driving a valve gear, or a flywheel magneto cover 200 for covering them are arranged in the upper portion of the engine in the outboard motor of the prior art.

It is necessary to arrange theses members or parts to detour the exhaust passage. In addition, since the exhaust passage 70 passes through the side of the cylinder block where the intake pipe (56) is arranged, it is necessary to provide a heat insulator for preventing overheating of the intake pipe 56. For this reason, in order to arrange the exhaust passage compactly in a relationship with neighboring members or effectively prevent flooding to the exhaust gas cleaning catalyst, the structure of the outboard motor becomes complicated and large-sized inevitably.

SUMMARY OF THE INVENTION

In view of the aforementioned problems, it is therefore an object of the present invention to provide an effectively compactified outboard motor having an excellent anti-flooding capability.

According to an aspect of the present invention, there is provided an outboard motor including: a four-cycle engine having a cylinder block provided with a plurality of cylinders vertically arranged side by side, and a cylinder head combined with the cylinders of the cylinder block to form each combustion chamber and provided with exhaust ports connected to the combustion chambers; an engine holder that supports the four-cycle engine and connects the four-cycle engine to a lower unit; an exhaust manifold having a plurality of first openings connected to a plurality of the exhaust ports to form a first passage vertically extending; and an exhaust passage having a second passage extending upward along the exhaust manifold, a third passage that is connected to an upper end portion of the second passage and passes over the exhaust manifold, and a fourth passage that is connected to the third passage, turns over to the downside, and then extends downward along the exhaust manifold, so that a lower end portion thereof communicates with a fifth passage provided in the engine holder, the second, third, and fourth passages being arranged in one side of the left-right direction of the cylinder block, wherein the exhaust passage is arranged in a swirling shape, and an exhaust gas cleaning catalyst is installed in a middle portion of the second passage.

In the outboard motor described above, the cylinders of the four-cycle engine may extend backward in a travel direction, the cylinder head may be arranged in a rear end portion, and the exhaust manifold that forms the first passage may be interposed between the second and fourth passages, so that the second passage is arranged in the front cylinder block side, and the fourth passage is arranged in the rear cylinder head side.

In the outboard motor described above, the second passage may be provided separately from the exhaust manifold, a coupling surface with the exhaust manifold and a coupling surface with the third passage may be formed in a coplanar manner, the second passage may be divided into an upper half and a lower half in its middle portion, and the lower and upper halves may be mirror-symmetric with respect to a dividing surface.

In the outboard motor described above, the first passage, the third passage, and a sixth passage that connects the fourth passage to a fifth passage of the engine holder may be formed integrally with the exhaust manifold, the fourth passage may be provided separately, a coupling surface between the fourth and third passages and a coupling surface between the fourth and sixth passages may be formed in a coplanar manner, and a coupling surface of the exhaust port between the exhaust manifold and the cylinder head and a coupling surface of the fifth passage formed between the engine holder and the exhaust manifold may be formed in a coplanar manner.

DETAILED DESCRIPTION OF THE PREFERRED EMBODIMENTS

A description will now be made for an outboard motor according to a preferable embodiment of the present invention with reference to the accompanying drawings.

Figure 1:
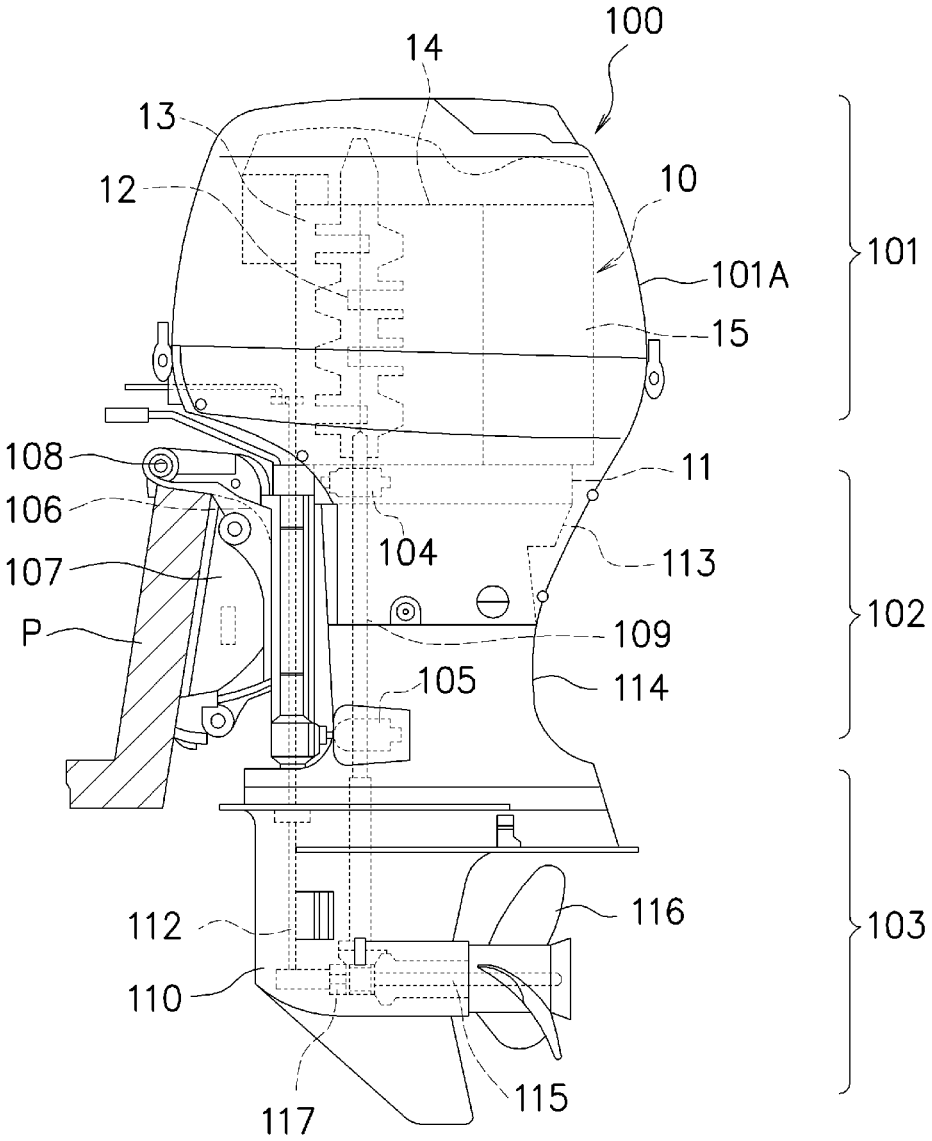
FIG. 1 is a left side view illustrating a schematic configuration example of an outboard motor according to the present invention.

FIG. 1 is a left side view illustrating a schematic configuration example of an outboard motor 100 according to the present invention. In this case, the outboard motor 100 is fixed to a stem plate P of the ship hull in its front side as illustrated in FIG. 1. It is noted that, in the following description for each drawing, the arrow Fr denotes a front side of the outboard motor 100, the arrow Rr denotes a rear side of the outboard motor 100, the arrow R denotes a right side of the outboard motor 100, and the arrow L denotes a left side of the outboard motor 100 as necessary.

In the entire configuration of the outboard motor 100, an upper unit 101, a middle unit 102, and a lower unit 103 are sequentially arranged from the upside to the downside. In the upper unit 101, the engine 10 is vertically mounted and supported by an engine holder 11 such that a crankshaft 12 is directed to a vertical direction. As the engine 10, various engine types such as a V-type multi-cylinder engine or an in-line multi-cylinder engine may be employed. A cylinder block 14, a cylinder head 15, and a cylinder head cover 16 are sequentially assembled to a crank casing 13 that supports the crankshaft 12. It is noted that the engine 10 is covered by the engine cover 101A.

The middle unit 102 is supported by upper and lower mounts 104 and 105 horizontally pivotably around a support shaft set in a swivel bracket 106. A clamp bracket 107 is provided in both sides of the swivel bracket 106, so that the middle unit 102 is fixed to the stem plate P of the ship hull by using the clamp bracket 107. The swivel bracket 106 is supported vertically pivotably around a tilt shaft 108 set in a left-right direction.

In the middle unit 102, a drive shaft 109 connected to a lower end portion of the crankshaft 12 of the engine 10 is arranged to vertically penetrate, so that a drive force of the drive shaft 109 is transmitted to a propeller shaft 115 arranged in a gear casing 110 of the lower unit 103. A shift rod 112 for shifting a gear position to forward or backward is arranged in front of the drive shaft 109 in parallel to the vertical direction. In addition, the middle unit 102 is also provided with an oil pan 113 for storing oil for lubricating the engine 10. It is noted that the middle unit 102 has a drive shaft housing 114 for housing the drive shaft 109.

In the lower unit 103, the gear casing 110 internally has a plurality of gear groups 117 and the like to rotatably drive the propeller 116 by using the propeller shaft 115 by virtue of the drive force of the drive shaft 109. In the gear group 117, a gear provided in the drive shaft 109 extending downward from the middle unit 102 meshes with the gear of the gear casing 110 so as to finally rotate the propeller 116. However, if a shift operation is performed by using the shift rod 112, a power transmission path of the gear group 117 in the gear casing 110 is switched, that is, shifted.

Figure 2:
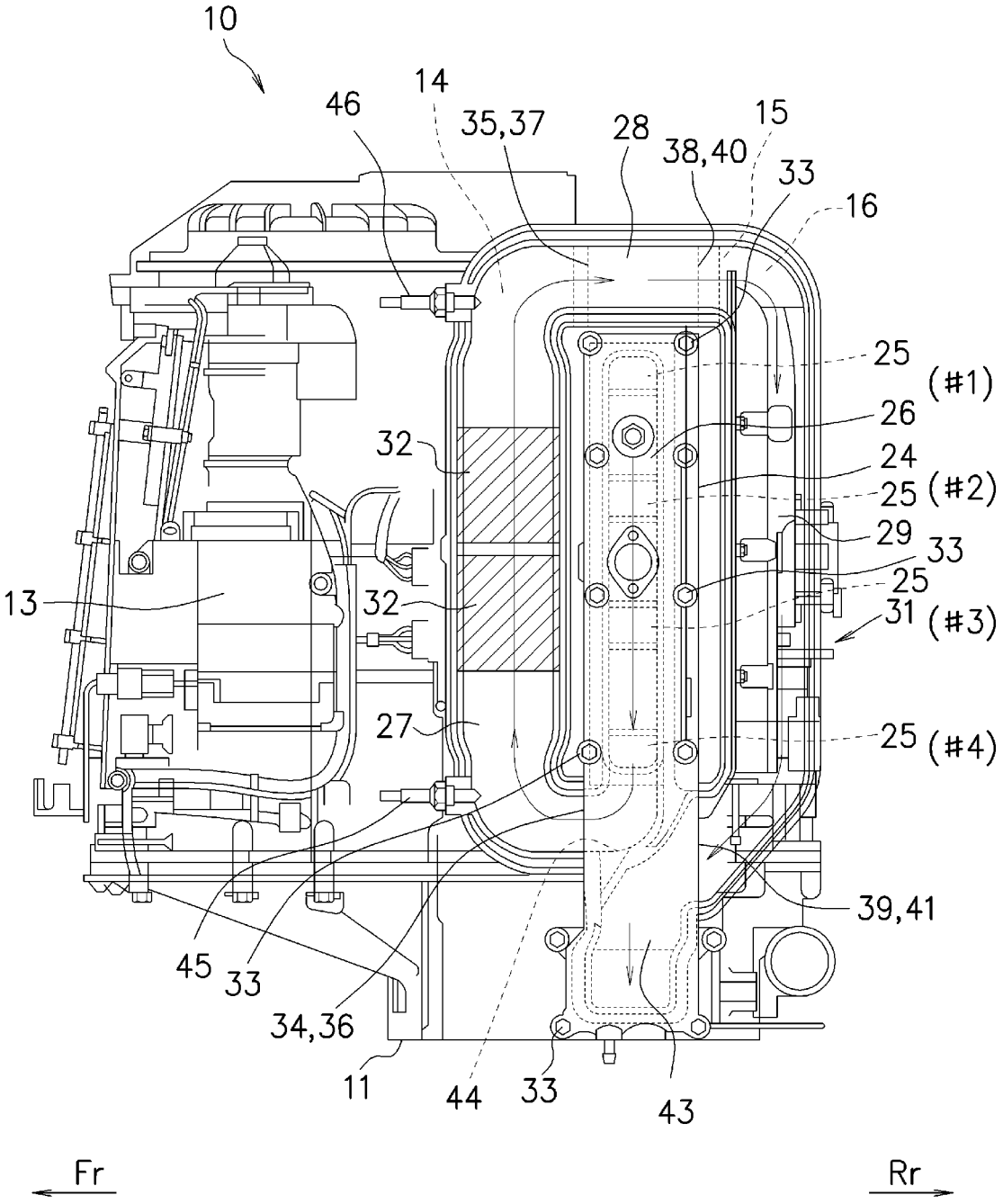
FIG. 2 is a left side view illustrating an engine of the outboard motor according to the present invention.
Figure 3:
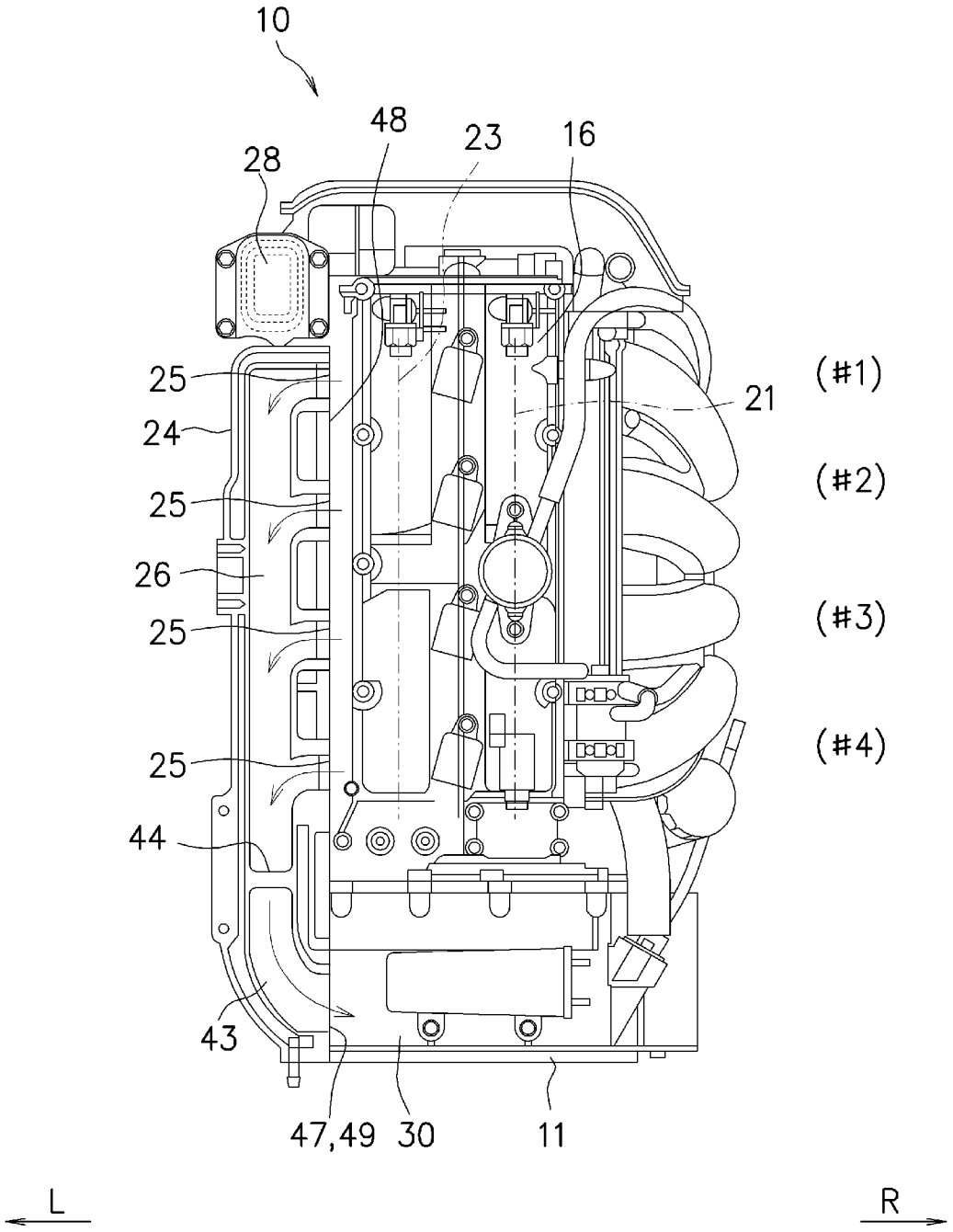
FIG. 3 is a rear view illustrating the engine of the outboard motor according to the present invention.
Figure 4:
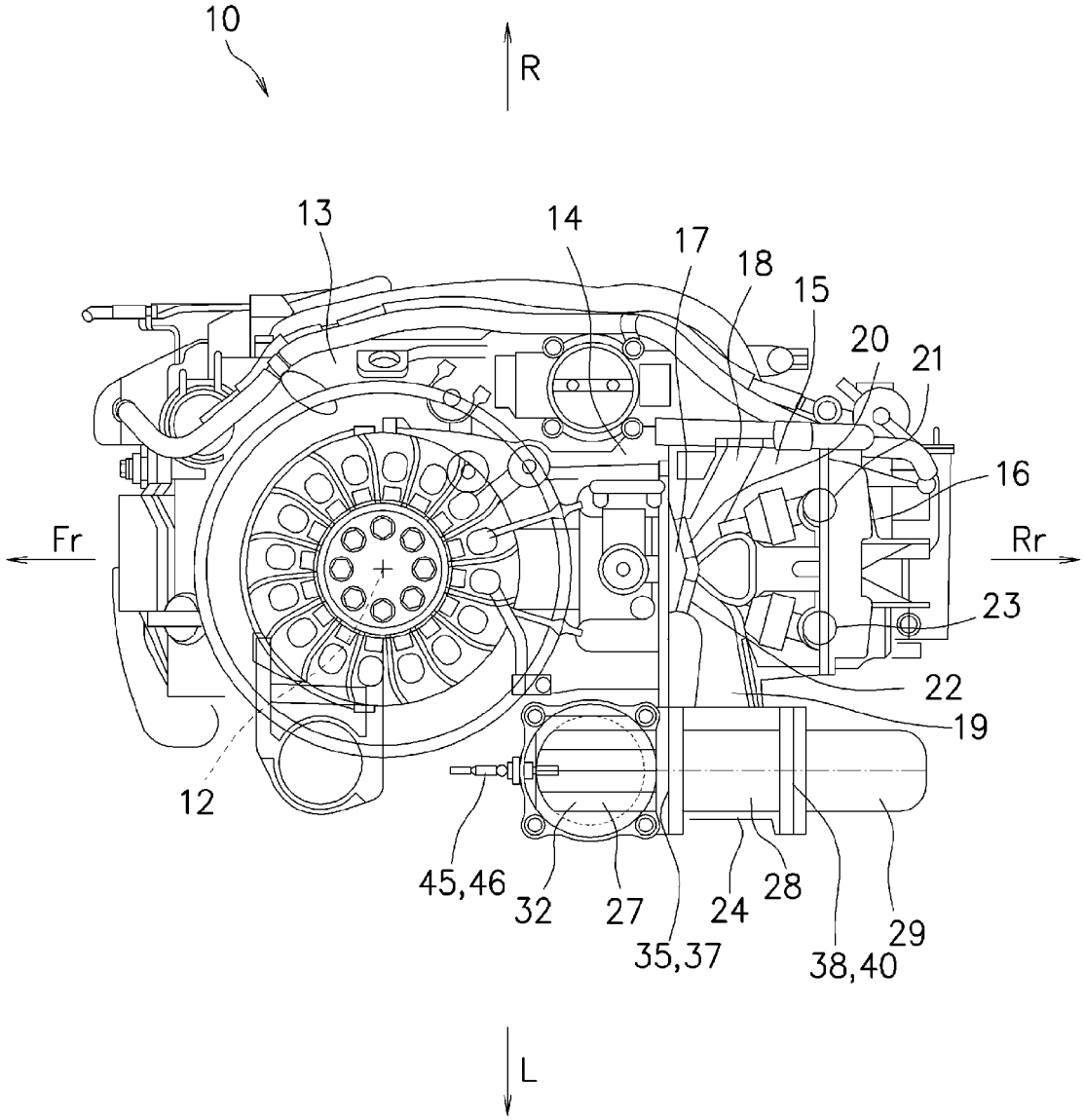
FIG. 4 is a top view illustrating the engine of the outboard motor according to the present invention.
Figure 5A:
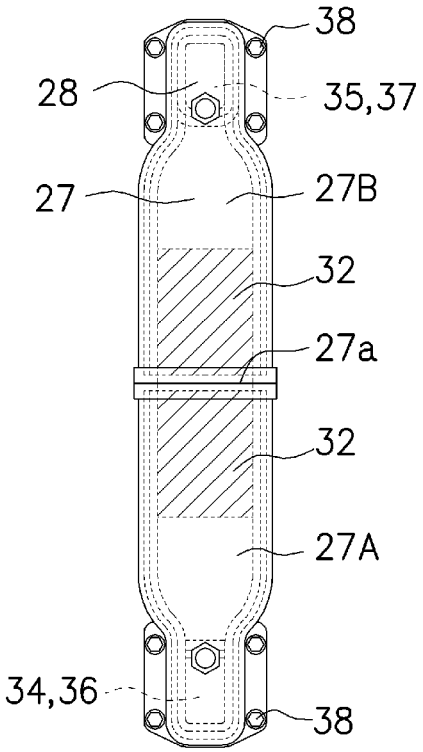
FIG. 5A is a front view illustrating an exhaust system of the engine of the outboard motor according to the present invention and its surroundings.
Figure 5B:
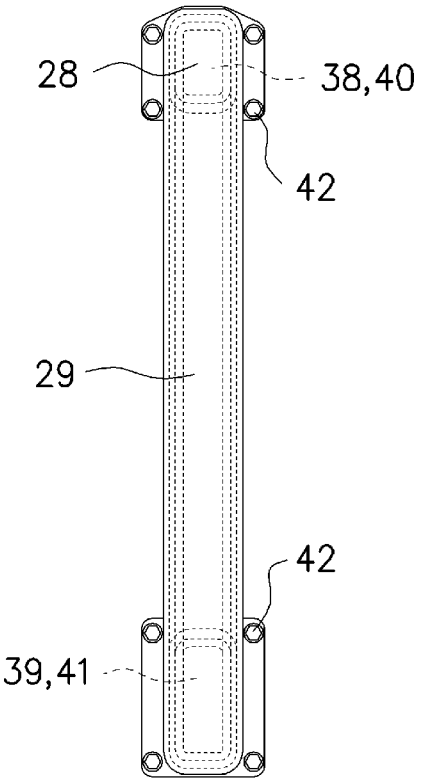
FIG. 5B is a rear view illustrating the exhaust system of the engine of the outboard motor according to the present invention and its surroundings.

FIGS. 2 to 55 illustrate an exemplary engine 10 according to this embodiment. FIG. 2 is a left side view illustrating the engine 10. FIG. 3 is a rear view illustrating the engine 10. FIG. 4 is a top view illustrating the engine 10. It is noted that FIG. 5A is a front view illustrating an exhaust system according to this embodiment and its surroundings, and FIG. 5B is a rear view illustrating the exhaust system according to this embodiment and its surroundings. It is assumed that the engine 10 of this embodiment is an in-line 4-cylinder engine, in which four cylinders including the first cylinder #1, the second cylinder #2, the third cylinder #3, and the fourth cylinder #4 are sequentially arranged from the upside as illustrated in FIG. 3. The engine 10 is mounted onto the engine holder 11 in the fourth cylinder (#4) side such that the crank casing 13 is arranged in the front side, and the cylinder head 15 is arranged in the rear side. Although the engine 10 will be described in brief, some of components thereof may be omitted or not as necessary for simplicity purposes.

In the crank casing 13, the crankshaft 12 is supported by a plurality of journal bearings in its upper end, middle, and lower end parts rotatably inside the crank casing 13. The lower end of the crankshaft 12 is also coupled to the upper end of the drive shaft 109, for example, by interposing a pair of coupling gear (reduction gear). As a result, the rotational force of the crankshaft 12 is transmitted to the drive shaft 109.

The cylinder block 14 is internally provided with cylinder bores for each cylinder, so that pistons are inwardly fitted to the cylinder bores in a reciprocatable manner (in the front-rear direction). The piston is connected to a crank pin of the crankshaft 12 through a connecting rod. As a result, a reciprocating motion of the piston inside the cylinder bore is converted into a rotational motion of the crankshaft 12, and is transmitted to the drive shaft 109 as an output power of the engine 10.

Referring to FIG. 4, the cylinder head 15 is provided with combustion chambers 17 matching cylinder bores of each cylinder and intake and exhaust ports 18 and 19 communicating with respective combustion chambers 17. For the open/close operation of the intake port 18, a communicating portion to the combustion chamber 17 is controlled by an intake valve 20. In this case, the intake valve 20 is driven by a cam provided in an intake cam shaft 21 extending vertically. In addition, for the open/close operation of the exhaust port 19, a communicating portion to the combustion chamber 17 is controlled by an exhaust valve 22. In this case, the exhaust valve 22 is driven by a cam provided in an exhaust cam shaft 23 extending vertically. It is noted that, according to this embodiment, each cylinder may have a four-valve structure having a pair of valves for each of the intake and exhaust sides.

On top of the combustion chamber 17 of each cylinder, an ignition plug is installed, so that a mixed gas supplied to the inside of the combustion chamber 17 is ignited by the ignition plug. In addition, a combustion gas exploded and combusted inside each cylinder bore of each cylinder is discharged from the exhaust port 19 to an exhaust manifold 24 described below. In each cylinder, the exhaust manifold 24 provided in the outer side portion of the cylinder bore of the cylinder block 14 is connected to the exhaust port 19 to communicate with each other. As illustrated in FIGS. 2 and 4, the exhaust manifold 24 is provided to vertically extend on the left side surface portion of the cylinder head 15 so that the exhaust gases from each exhaust port 19 are joined. The exhaust gas passes through the exhaust manifold 24 and is finally guided to the lower side of the engine 10 as described below. Furthermore, the exhaust gas passes through an exhaust passage formed inside the engine holder 11 and is finally discharged to the water.

As an exemplary configuration of the engine 10 of the outboard motor 100 according to the present invention, a catalyst-mounted model will be described. As illustrated in FIGS. 2 and 4, the exhaust system of the engine 10 has the exhaust manifold 24 provided with a plurality of first openings 25 (four openings in this embodiment) connected to a plurality of exhaust ports 19 (four exhaust ports in this embodiment) to form a first passage 26 vertically extending.

The exhaust system has an exhaust passage 31 arranged in one side of the left-right direction of the cylinder block 14 (the left side in this embodiment, but the right side may also be possible), including a second passage 27 extending upward along the exhaust manifold 24, a third passage 28 that is connected to the upper end portion of the second passage 27 and passes through the upper side of the exhaust manifold 24, and a fourth passage 29 that is connected to the third passage 28, turns over to the downside, and then extends downward along the exhaust manifold 24, so that the lower end portion thereof communicates with the fifth passage 30 provided in the engine holder 11.

According to the present invention, in particular, the exhaust passage 31 including the exhaust manifold 24 is arranged in a swirling shape, and an exhaust gas cleaning catalyst 32 is installed in a middle portion of the second passage 27 as the engine 10 is seen in the side view as illustrated in FIG. 2. This swirling shape is formed by sequentially connecting the first, second, third, and fourth passages 26, 27, 28, and 29 to the exhaust manifold 24.

The exhaust manifold 24 has a cavity structure having an approximately rectangular cross-sectional shape. The exhaust manifold 24 is fastened to the left side surface portion of the cylinder head 15 by using a plurality of bolts 33 as fastening means. The exhaust manifold 24 can be uninstalled from the cylinder head 15 by removing the bolts 33.

In the aforementioned case, the exhaust manifold 24 that forms the first passage 26 is interposed between the second and fourth passages 27 and 29 such that the second passage 27 is arranged in the front cylinder block 14 side, and the fourth passage 29 is arranged in the rear cylinder head 15 side.

The second passage 27 is provided separately from the exhaust manifold 24. As illustrated in FIG. 2, a coupling surface 34 with the exhaust manifold 24 and a coupling surface 35 with the third passage 28 are formed in a coplanar manner (on the plane extending vertically and perpendicularly to the paper plane in FIG. 2).

The lower portion of the second passage 27 communicates with the lower portion of the first passage 26 through the communication hole 36 provided on the coupling surface 34. In addition, the upper portion of the second passage 27 communicates with the third passage 28 through the communication hole 37 provided on the coupling surface 35. Similarly, for the upper and lower portions of the second passage 27, the coupling portions with the exhaust manifold 24 and the third passage 28 are formed in a flange shape and are fastened to the coupling surfaces 34 and 35, respectively, by using the bolts 38 as illustrated in FIG. 5A.

Here, the second passage 27 is vertically divided into a lower half 27A and an upper half 27B in its middle portion, and the lower and upper halves 27A and 27B are mirror-symmetric with respect to the dividing surface 27*a*. In this case, the lower and upper halves 27A and 27B of the second passage 27 vertically divided with respect to the dividing surface 27*a* are formed in a flange shape, and the flange-shaped portions are engaged with each other by using bolts and the like. The exhaust gas cleaning catalyst 32 may be installed to an opening formed in the dividing surface 27*a* of the vertically divided second passage 27.

The fourth passage 29 may be formed integrally with the third passage 28. Alternatively, the fourth passage 29 may be provided separately. Here, it is assumed that the third and fourth passages 28 and 29 are provided separately, and the coupling surface 28 with the third passage 28 and the coupling surface 39 with the exhaust manifold 24 are formed in a coplanar manner as illustrated in FIG. 2 (on the surface extending vertically and perpendicularly to the paper plane in FIG. 2).

The upper portion of the fourth passage 29 communicates with the third passage 28 through the communication hole 40 provided on the coupling surface 38. In addition, the lower portion of the fourth passage 29 communicates with the exhaust manifold 24 through the communication hole 41 provided on the coupling surface 39. Similarly, for the upper and lower portions of the fourth passage 29, the coupling portions with the third passage 28 and the exhaust manifold 24 are formed in a flange shape and are fastened to the coupling surfaces 38 and 39, respectively, by using bolts 42 as illustrated in FIG. 5B.

In this case, the exhaust manifold 24 has a sixth passage 43 for connecting the fourth passage 29 to the fifth passage 30 of the engine holder 11. The lower portion of the fourth passage 29 is connected to the exhaust manifold 24 on the coupling surface 39 as described above and directly communicates with the sixth passage 43.

In addition, a partitioning wall 44 for partitioning the first and sixth passages 26 and 43 is provided inside the exhaust manifold 24 as illustrated in FIG. 2.

Furthermore, an oxygen sensor 45 for detecting an oxygen concentration in the exhaust gas is installed in the second passage 27 under the exhaust gas cleaning catalyst 32 (in the upstream side of the exhaust gas) as illustrated in FIG. 2. Using the oxygen sensor 45, it is possible to detect an oxygen concentration in the upstream side from the exhaust gas cleaning catalyst 32.

Moreover, an oxygen sensor 46 for detecting an oxygen concentration in the exhaust gas is similarly installed over the exhaust gas cleaning catalyst 32 (in the downstream side of the exhaust gas) as necessary. Using the oxygen sensor 46, it is possible to detect an oxygen concentration in the downstream side from the exhaust gas cleaning catalyst 32.

The outboard motor 100 according to the present invention is configured as described above. In the exhaust system of the engine 10 in this embodiment, the exhaust gases from each exhaust port 19 flow into the first opening 25 and are joined in the first passage 26. The confluent exhaust gas flows downward inside the first passage 26 and flows upward from the lower side inside the second passage 27 while it passes through the exhaust gas cleaning catalyst 32. The exhaust gas then flows to the fourth passage 29 from the upper side through the third passage 28. The exhaust gas flowing from the fourth passage 29 to the sixth passage 43 further flows to the fifth passage 30 of the engine holder 11 through a second opening (refer to FIG. 3). Further, the exhaust gas passes through the exhaust passage provided in the lower unit 103 and is finally discharged to the water.

In particular, the exhaust passage 31 for flowing the exhaust gas as described above is arranged in a swirling shape, and is disposed in one side of the left-right direction of the cylinder block 14 (the left side in this example). Therefore, the exhaust passage 31 becomes compact. In addition, the highest portion of the exhaust passage 31 in terms of the height is set in the downstream side from the exhaust gas cleaning catalyst 32. Therefore, it is possible to effectively prevent flooding caused by the water reversely flowing inside the exhaust passage 31. That is, by setting the third passage 28 in the highest position in the exhaust passage 31, it is possible to prevent reflux of water toward the exhaust gas cleaning catalyst 32 installed in the upstream side of the exhaust gas.

In a practical use of the outboard motor 100, a rotation of the propeller may be reversed by performing a gear shift operation from a forward drive to a backward drive by using a gearshift mechanism of the outboard motor, for example, in order to stop a ship. In this case, if the throttle valve is abruptly closed, the propeller may be forced to rotate in a forward drive direction due to a water pressure. In this state, the engine operation is reversed, and the exhaust passage has a negative pressure, so that the surrounding water may rise inside the exhaust passage. Even in this case, since the highest portion of the exhaust passage 31 is set as described above, it is possible to prevent the water reversely flowing inside the exhaust passage 31 from arriving at and making contact with the exhaust gas cleaning catalyst 32.

In the engine 10 having the crank casing 13 arranged in the front side and the cylinder head 15 arranged in the rear side, the second passage 27 is arranged in the front cylinder block 14 side, and the fourth passage 29 is arranged in the rear cylinder head 15 side.

Since the second passage 27 is installed with the exhaust gas cleaning catalyst 32, a diameter and a weight of the second passage 27 easily becomes larger and heavier than those of the fourth passage 29. Since such a heavy component is arranged close to a steering axle (referring to FIG. 1, set in the swivel bracket 106), it is possible to reduce an inertial moment around the steering axle and improve maneuverability.

The second passage 27 is provided separately from the exhaust manifold 24, and the coupling surface 34 with the exhaust manifold 24 and the coupling surface 35 with the third passage 20 are formed in a coplanar manner. In this case, the second passage 27 is vertically divided into the lower and upper halves 27A and 27B, and the lower and upper halves 27A and 27B are arranged in a mirror-symmetrical manner.

As a result, it is possible to form the lower and upper halves 27A and 27B by sharing components. Therefore, it is possible to reduce a manufacturing cost and thus contribute to cost reduction.

Furthermore, in this embodiment, since the exhaust passage 31 is compactly arranged in the left side of the cylinder block 14, it is not necessary to provide a special heat insulator for an intake system arranged in the right side of the cylinder block 14. As a result, it is possible to effectively simplify a device configuration around the intake system and the exhaust system.

According to a modification of the present invention, the first passage 26, the third passage 28, and the sixth passage 43 for connecting the fourth passages 29 to the fifth passage 30 of the engine holder 11 may be formed integrally with the exhaust manifold 24, and the fourth passage 29 may be provided separately. It is noted that the second passage 27 is provided separately from the exhaust manifold 24.

In this case, the coupling surface 38 between the fourth passage 29 and the third passage 28 and the coupling surface 39 between the fourth passage 29 and the exhaust manifold 24, i.e., the coupling surface 39 of the sixth passage 43 are formed in a coplanar manner. In addition, referring to FIG. 3, the coupling surface 48 between the exhaust manifold 24 and the (exhaust port 19 of the) cylinder head 14 and the coupling surface 49 between the exhaust manifold 24 and the fifth passage 30 provided in the engine holder 11 are formed in a coplanar manner. It is noted that the coupling surface 49 is provided with the second opening 47.

In this manner, if the coupling surfaces 38 and 39 or the coupling surfaces 48 and 49 provided in the exhaust manifold 24 or each passage are formed in a coplanar manner, it is possible to improve its manufacturability. Furthermore, since a coupling strength between the components of the exhaust passage 31 and the exhaust manifold 24 is improved, it is possible to substantially reduce thicknesses of each component, and this contribute to both cost reduction and weight reduction.

Alternatively, according to a modification of the present invention, the third and fourth passages 28 and 29 may be formed integrally. In addition, they may also be formed integrally with the first and sixth passages 26 and 43.

Figure 6:
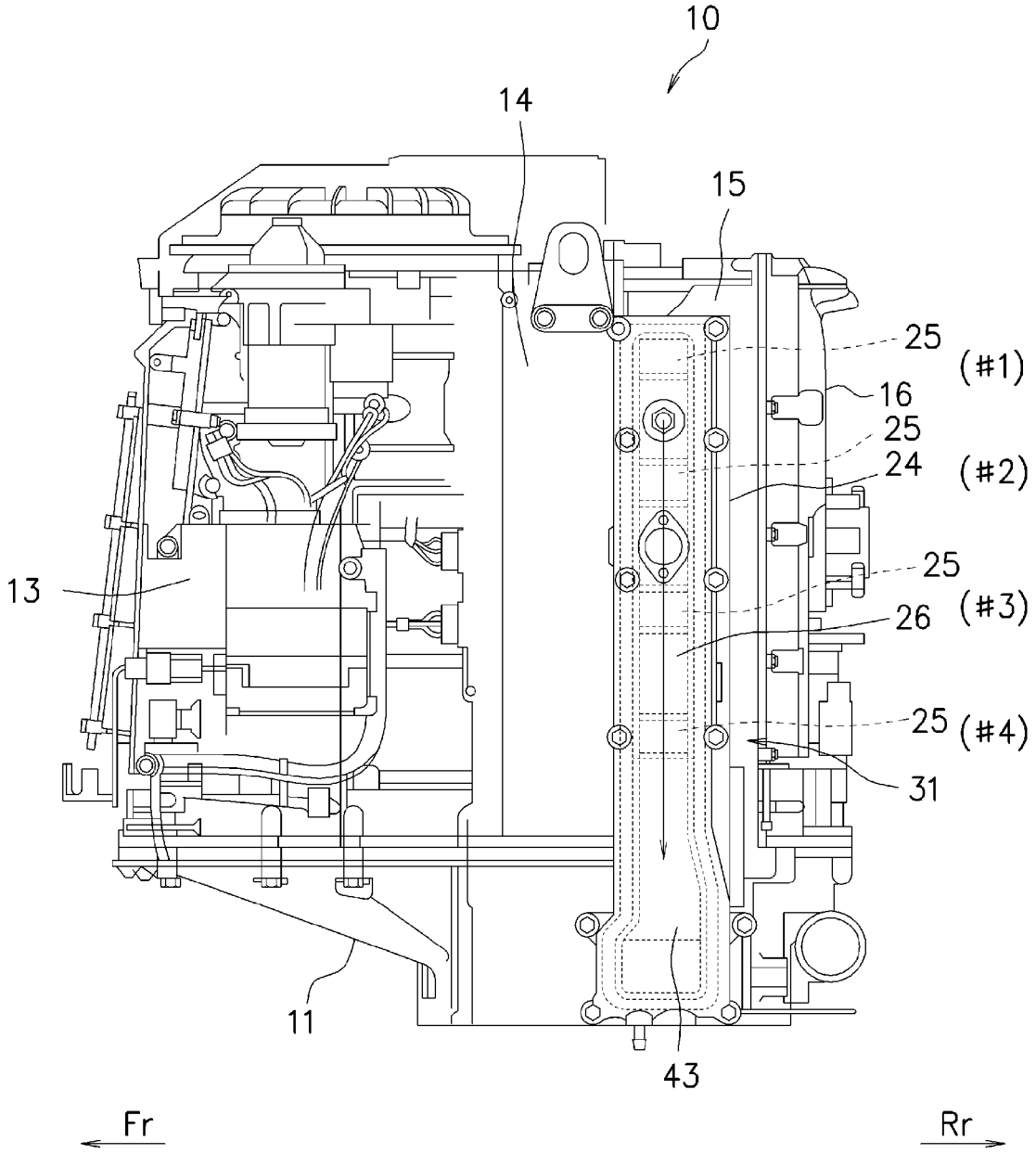
FIG. 6 is a left side view illustrating an engine of an outboard motor according to another embodiment of the present invention.
Figure 7:
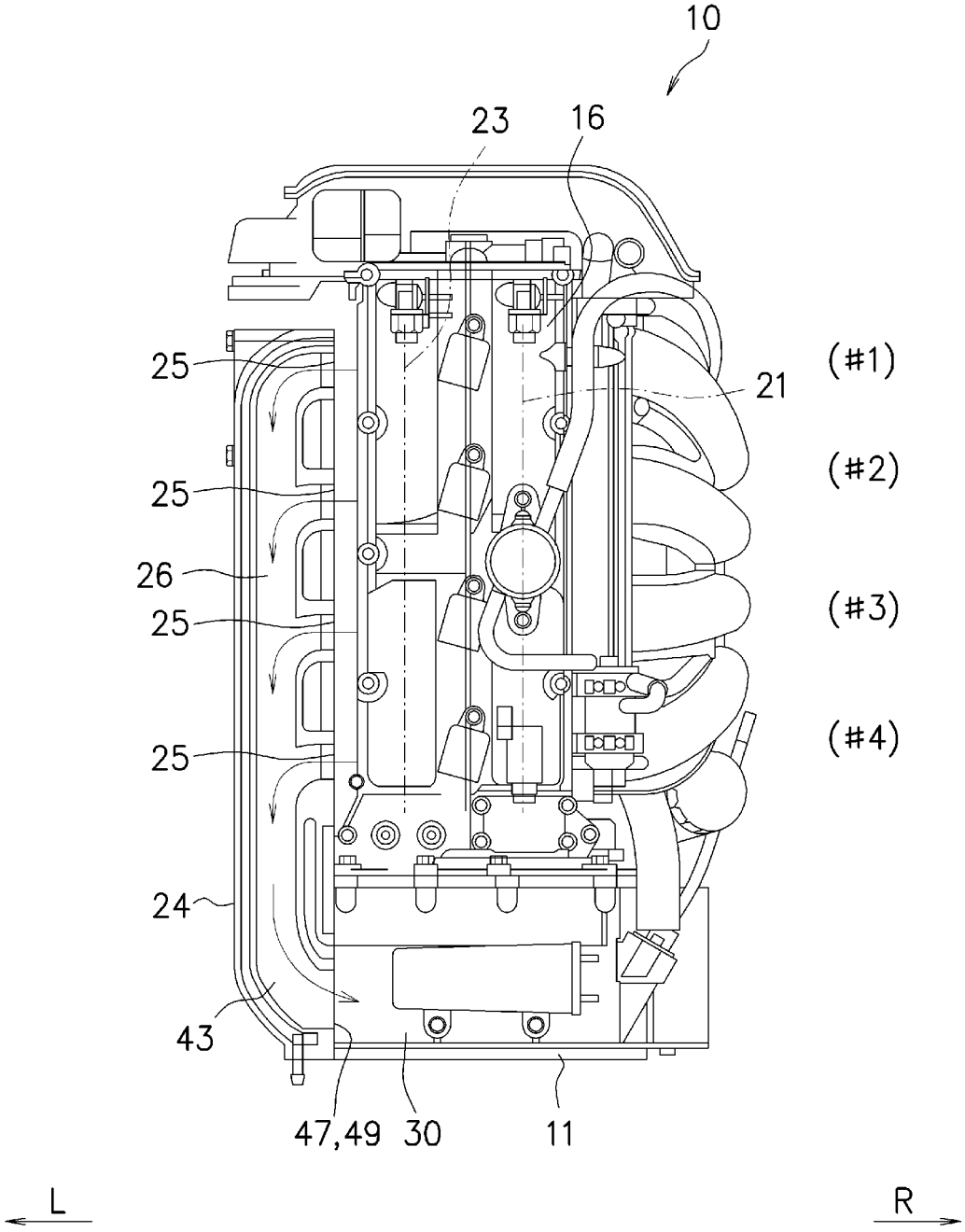
FIG. 7 is a rear view illustrating the engine of the outboard motor according to another embodiment of the present invention.

FIGS. 6 and 7 illustrate an exhaust system in a non-catalyst-mounted model as an exemplary configuration of the engine 10. FIG. 6 is a left side view illustrating the engine 10, and FIG. 7 is a rear view illustrating the engine 10. In the exhaust manifold 24 of this example, the first and sixth passages 26 and 43 directly communicate with each other, and the exhaust gas cleaning catalyst 32 is not provided in the exhaust passage 31. That is, the partitioning wall 44 (refer to FIG. 2) between the first and sixth passages 26 and 43 is not provided, and only the exhaust manifold 24 is provided. Other parts are substantially similar to those of the aforementioned case.

In the exhaust manifold 24 of this embodiment, the exhaust gases from each exhaust port 19 flow to the first opening 25 and are joined in the first passage 26. The confluent exhaust gas flows downward inside the first passage 26 and flows to the sixth passage 43. Then, the exhaust gas flows to the fifth passage 30 of the engine holder 11 through the second opening 47 and is finally discharged to the water.

In the outboard motor 100 of the present invention, in particular, the exhaust manifold 24 is provided separately from the cylinder head 15 and the cylinder block 14 and is detachably installed to the main body of the engine 10. In the case of the catalyst-mounted model, the exhaust gas cleaning catalyst 32 is provided in the exhaust passage 31 as illustrated in FIG. 2. Meanwhile, in the case of the non-catalyst-mounted model, the exhaust passage 31 is not provided as illustrated in FIG. 6. The outboard motor 100 may be implemented as a catalyst compatible type capable of sharing the engine 10 between the catalyst-mounted model and the non-catalyst-mounted model by allowing the exhaust gas cleaning catalyst 32 to be installed in or uninstalled from the same engine 10.

According to the present invention, since the exhaust passage is formed in a swirling shape and is disposed in one side of the left-right direction of the cylinder block, the exhaust passage becomes compact. In addition, since the highest portion of the exhaust passage is set in the downstream side from the exhaust gas cleaning catalyst, it is possible to effectively prevent flooding caused by the water reversely flowing inside the exhaust passage.

While various embodiments of the present invention have been described in detail hereinbefore, it would appreciated that they are not intended to limit the present invention, but various changes or modifications may be possible without departing from the spirit and scope of the invention.

For example, although the engine 10 is an in-line four-cylinder engine in the aforementioned embodiment, the number of cylinders in the engine 10 may increase or decrease without a limitation.

What is claimed is:

1. An outboard motor comprising:

a four-cycle engine having a cylinder block provided with a plurality of cylinders extending backward in a travel direction and vertically arranged side by side, and a cylinder head being arranged in a rear end portion and combined with the cylinders of the cylinder block to form each combustion chamber and provided with exhaust ports connected to the combustion chambers;

an engine holder that supports the four-cycle engine and connects the four-cycle engine to a lower unit;

an exhaust manifold having a plurality of first openings connected to a plurality of the exhaust ports to form a first passage vertically extending; and an exhaust passage having a second passage extending upward along the exhaust manifold, a third passage that is connected to an upper end portion of the second passage and passes above the exhaust manifold, and a fourth passage that is connected to the third passage, turns over downward, and then extends downward along the exhaust manifold, so that a lower end portion thereof communicates with a fifth passage provided in the engine holder, the second, third, and fourth passages being arranged in one side of a left-right direction of the cylinder block, wherein an exhaust gas cleaning catalyst is installed in a middle portion of the second passage, and wherein the exhaust manifold that forms the first passage is interposed between the second and fourth passages, so that the second passage is arranged in a front side of the exhaust manifold in the travel direction, and the fourth passage is arranged in a rear side of the exhaust manifold in the travel direction.

2. The outboard motor according to claim 1, wherein the second passage is provided separately from the exhaust manifold, a coupling surface with the exhaust manifold and a coupling surface with the third passage are formed in a coplanar manner, the second passage is divided into an upper half and a lower half in its middle portion, and the lower and upper halves are mirror-symmetric with respect to a dividing surface.

3. The outboard motor according to claim 1, wherein the second passage is provided separately from the exhaust manifold, a coupling surface with the exhaust manifold and a coupling surface with the third passage are formed in a coplanar manner, the second passage is divided into an upper half and a lower half in its middle portion, and the lower and upper halves are mirror-symmetric with respect to a dividing surface.

4. The outboard motor according to claim 1, wherein the first passage, the third passage, and a sixth passage that connects the fourth passage to a fifth passage of the engine holder are formed integrally with the exhaust manifold, the fourth passage is provided separately, a coupling surface between the fourth and third passages and a coupling surface between the fourth and sixth passages are formed in a coplanar manner, and a coupling surface of the exhaust port between the exhaust manifold and the cylinder head and a coupling surface of the fifth passage formed between the engine holder and the exhaust manifold are formed in a coplanar manner.

* * * * *